US011205564B2

(12) United States Patent
Clark et al.

(10) Patent No.: US 11,205,564 B2
(45) Date of Patent: Dec. 21, 2021

(54) ELECTROSTATIC GRID DEVICE TO REDUCE ELECTRON SPACE CHARGE

(71) Applicant: Modern Electron, LLC, Bellevue, WA (US)

(72) Inventors: Stephen E. Clark, Bellevue, WA (US); Richard M. Gorski, Arlington Heights, IL (US); Arvind Kannan, Bellevue, WA (US); Andrew T. Koch, Seattle, WA (US); Andrew R. Lingley, Seattle, WA (US); Hsin-I Lu, Mercer Island, WA (US); Max N. Mankin, Seattle, WA (US); Tony S. Pan, Bellevue, WA (US); Jason M. Parker, Redmond, WA (US)

(73) Assignee: MODERN ELECTRON, INC., Bothell, WA (US)

( * ) Notice: Subject to any disclaimer, the term of this patent is extended or adjusted under 35 U.S.C. 154(b) by 167 days.

(21) Appl. No.: 15/986,728

(22) Filed: May 22, 2018

(65) Prior Publication Data

US 2019/0371582 A1 Dec. 5, 2019

Related U.S. Application Data

(60) Provisional application No. 62/509,941, filed on May 23, 2017.

(51) Int. Cl.

| | |
|---|---|
| ***H01J 45/00*** | (2006.01) |
| ***H01J 21/36*** | (2006.01) |
| ***H01J 9/04*** | (2006.01) |

(52) U.S. Cl.
CPC ..... *H01J 45/00* (2013.01); *H01J 9/04* (2013.01); *H01J 21/36* (2013.01)

(58) Field of Classification Search
None
See application file for complete search history.

(56) References Cited

U.S. PATENT DOCUMENTS

| | | | |
|---|---|---|---|
| 3,041,481 | A | 6/1962 | Peters et al. |
| 3,254,244 | A | 5/1966 | Milton et al. |
| 3,297,902 | A | 1/1967 | Beggs |
| 3,694,260 | A | 9/1972 | Beggs |
| 4,263,528 | A | 4/1981 | Miram |
| 4,361,781 | A | 11/1982 | Depp et al. |
| 4,405,878 | A | 9/1983 | Oliver |
| 4,771,201 | A | 9/1988 | Free |

(Continued)

FOREIGN PATENT DOCUMENTS

EP 0068111 B1 11/1985

*Primary Examiner* — Ashok Patel
(74) *Attorney, Agent, or Firm* — Perkins Coie LLP

(57) ABSTRACT

Disclosed embodiments include vacuum electronic devices, methods of operating a vacuum electronic device, and methods of fabricating a vacuum electronic device. In a non-limiting embodiment, a vacuum electronics device includes a cathode and an anode. At least one focus grid is disposed between the cathode and the anode, and the at least one focus grid is physically disconnected from the cathode. The at least one acceleration grid is disposed between the cathode and the anode, and the at least one acceleration grid is further disposed adjacent the at least one focus grid. The at least one acceleration grid is physically disconnected from the cathode.

29 Claims, 4 Drawing Sheets

(56) References Cited

U.S. PATENT DOCUMENTS

| | | | | |
|---|---|---|---|---|
| 6,225,761 | B1 * | 5/2001 | Dworsky | H01J 29/46 313/495 |
| 6,987,027 | B2 | 1/2006 | Jin | |
| 2003/0001490 | A1 * | 1/2003 | Yamamoto | H01J 9/025 313/495 |
| 2005/0016576 | A1 | 1/2005 | Jiang et al. | |
| 2005/0162104 | A1 * | 7/2005 | Victor | H01J 31/06 315/321 |
| 2005/0258729 | A1 * | 11/2005 | Han | H01J 29/481 313/309 |
| 2005/0285541 | A1 * | 12/2005 | LeChevalier | H01J 3/36 315/169.3 |
| 2007/0252507 | A1 * | 11/2007 | Jeong | H01J 1/304 313/309 |
| 2018/0294133 | A1 * | 10/2018 | Busta | H01J 19/32 |

* cited by examiner

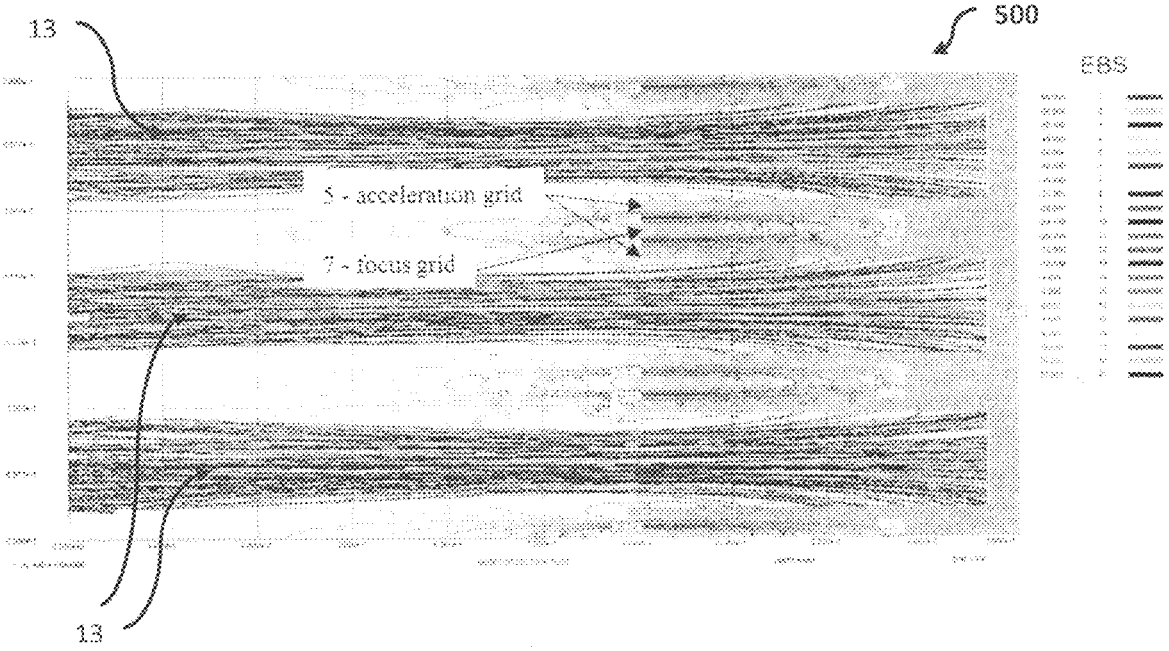
FIG. 6
FIG. 7A FIG. 7B FIG. 7C FIG. 7D
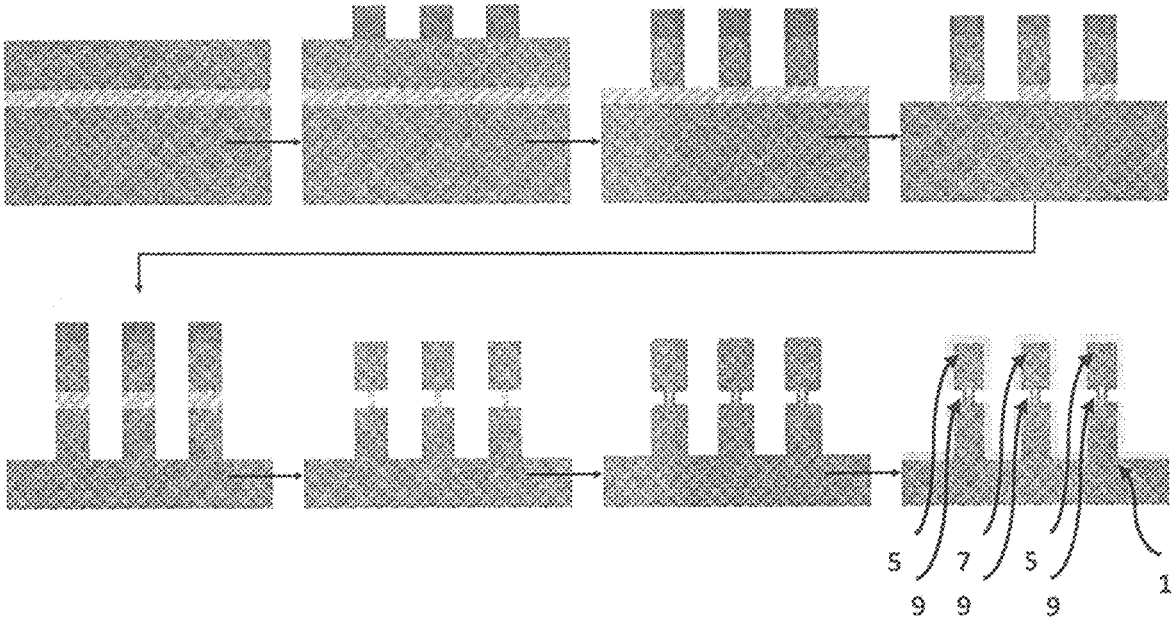
FIG. 7E FIG. 7F FIG. 7G FIG. 7H

ELECTROSTATIC GRID DEVICE TO REDUCE ELECTRON SPACE CHARGE

TECHNICAL FIELD

The present disclosure relates to vacuum electronic devices.

BACKGROUND

A vacuum electronic device typically includes an electrode, such as a cathode, which emits electrons over a potential energy barrier to a cooler electrode, such as an anode, thereby producing a useful electrical current. In some applications, such as a thermionic energy converter, vapor may be used to optimize electrode work functions and provide an ion supply (such as by surface ionization or electron impact ionization in a plasma) to neutralize electron space charge. As is known, in an electron tube, for example, a negative charge results because electrons that are emitted from the cathode do not travel instantaneously to the anode but require a finite time for the trip. These electrons form a cloud around the cathode, and the cloud is continually depleted by electrons being absorbed by the plate and replenished by electrons being emitted from the cathode. It is this cloud of electrons that produces the negative space charge.

Space charge can limit practicality of thermionic energy converters. As electrons are emitted between the electrodes, their negative charges repel one another and disrupt the current.

Some methods previously explored to mitigate or eliminate space charge include using a close gap (that is, <10 μm or so), using an easily ionizable gas in the inter-electrode space, and using electric or magnetic fields to accelerate electrons across the gap. Close-spaced converters present engineering challenges in maintaining a very small gap with large temperature gradients and thermal expansion, as well as material choices for spacers. The maximum cathode dimensions can be limited because cathode heating and the resulting thermal expansion can cause the gap to vary. Vapor diodes, as converters containing cesium are frequently called, have complexities arising from corrosion, pressure control, and anode temperature requirements. In addition, vapor diodes are usually operated under a condition where a plasma is struck, which typically results in a ~50% power loss associated with the additional potential barrier created by the plasma sheath region.

Electrostatically reducing space charge with grids may be attractive because it allows for larger gaps and easier manufacturing. However, using a single grid that is positively charged (or positively biased) relative to the cathode (an "acceleration grid") to reduce space charge may not be practical because the acceleration grid itself attracts and absorbs electrons. Therefore, the power required to maintain the acceleration grid at a positive bias relative to the cathode offsets gains in space charge reduction. In such a thermionic converter, electron absorption by the acceleration grid(s) is desirably limited to avoid significant power consumption by the grid(s) ("grid loss").

Some attempts have been made to reduce grid loss (that is, absorption of electrons emitted from the cathode by the acceleration grid) in a gridded thermionic generator. These attempts include: 1) create extremely small acceleration grids; 2) introduce a longitudinal magnetic field to the inter-electrode space; and 3) form one or more collimated electron beams from the electrons emitted from the cathode.

In the first case, the acceleration grids are small in fill factor (that is, the ratio of exposed grid area to exposed anode area as seen from the cathode) such that the probability of an electron striking the grid is sufficiently low. In the second case, the longitudinal magnetic field creates a Lorentz force that acts on the transverse component of the electron's velocity, which holds the electron to a helical path and prevents significant deflection toward the grid in the transverse direction. In the third case, the emitted electrons are collimated (that is, the potential profile near the cathode surface due to electrostatic grid structures results in emitted electrons having relatively parallel velocity vectors), and therefore the subsequent grid electrode(s) may be tailored in terms of geometry and voltage ("electron optics") to accelerate the electrons toward the anode while avoiding striking the grid electrodes.

In the third case of collimated emitted electrons, it may be desired to introduce one or more negatively biased electrostatic grids ("focus grids") to constrain the electron beam(s) such that absorption by the one or more positively biased acceleration grids can be minimized. The one or more negatively biased focus grids are desirably sufficiently close to the cathode surface such that emission is suppressed in desired areas, thereby allowing for the thermionic emission of electrons to be localized and aligned to the acceleration grid(s). Such an arrangement may be advantageous in terms of the degree to which electrons can be accelerated away from the cathode while avoiding striking the positively biased acceleration grid.

However, currently known methods of achieving localized emission and/or focusing of electron beams from a cathode surface have relied on patterned electrodes which are in physical contact with the cathode surface.

For example, one previously proposed method of localizing cathode emission coats the surface of the cathode with an insulator, such as boron nitride, and then puts the control grid directly on the insulator. This method limits the type of material from which the cathode can be made and increases the complexity of the cathode—which can run at temperatures ranging from 800° C. to 2000° C.

As another example, another method patterns emissive material only on certain areas of the cathode. In this approach, thermal mismatch can result between these emissive materials and the cathodes to which they are attached. Additionally, the emissive materials may diffuse over the course of operating at high temperature—which could potentially increase the emission area.

Moreover, in currently known vacuum electronics devices alignment between the focus grid and the acceleration grid is exclusively on the cathode side, thereby increasing chances for misalignment between the emitting area of the cathode and the accelerating region of the anode. When used in a thermionic generator, any misalignment would result in thermionic electrons being emitted in closer proximity to an acceleration grid, thereby degrading device efficiency.

SUMMARY

Disclosed embodiments include vacuum electronic devices, methods of operating a vacuum electronic device, and methods of fabricating a vacuum electronic device.

In a non-limiting embodiment, a vacuum electronics device includes a cathode and an anode. At least one focus grid is disposed between the cathode and the anode, and the at least one focus grid is physically disconnected from the cathode. The at least one acceleration grid is disposed between the cathode and the anode, and the at least one acceleration grid is further disposed adjacent the at least one focus grid. The at least one acceleration grid is physically disconnected from the cathode.

In another non-limiting embodiment, a device includes a cathode and an anode. At least one focus grid is biased negatively relative to the cathode and is disposed between the cathode and the anode. The at least one focus grid is physically disconnected from the cathode, and the at least one focus grid establishes a portion of a surface of the cathode adjacent thereto having a first level of emission of electrons therefrom. At least one acceleration grid is biased positively relative to the cathode and is disposed between the cathode and the anode. The at least one acceleration grid is further disposed adjacent the at least one focus grid, and the at least one acceleration grid is physically disconnected from the cathode. The at least one acceleration grid establishes a portion of a surface of the cathode adjacent thereto having a second level of emission of electrons therefrom that is greater than the first level of emission of electrons.

In another non-limiting embodiment, a method of reducing electron space charge includes: negatively biasing at least one focus grid relative to a cathode, the at least one focus grid being disposed between the cathode and an anode in a vacuum electronics device, the at least one focus grid being physically disconnected from the cathode; and positively biasing at least one acceleration grid relative to the cathode, the at least one acceleration grid being disposed between the cathode and the anode, the at least one acceleration grid being further disposed adjacent the at least one focus grid, the at least one acceleration grid being physically disconnected from the cathode.

In another non-limiting embodiment, a method of establishing localized emission of electrons in a vacuum electronics device includes: negatively biasing at least one focus grid relative to a cathode, the at least one focus grid being disposed between the cathode and an anode in a vacuum electronics device, the at least one focus grid being physically disconnected from the cathode, wherein negatively biasing the at least one focus grid relative to the cathode establishes a first level of emission of electrons from a portion of a surface of the cathode adjacent thereto; and positively biasing at least one acceleration grid relative to a cathode, the at least one acceleration grid being disposed between the cathode and the anode, the at least one acceleration grid being further disposed adjacent the at least one focus grid, the at least one acceleration grid being physically disconnected from the cathode, wherein positively biasing the at least one acceleration grid relative to the cathode establishes a second level of emission of electrons from a portion of a surface of the cathode adjacent thereto, the second level of emission of electrons being greater than the first level of emission of electrons.

In another non-limiting embodiment, a method of fabricating a vacuum electronics device includes: providing a silicon-on-insulator substrate; patterning with photoresist a plurality of features including at least one focus grid and at least one acceleration grid; etching to the insulator the silicon overlying the insulator; etching the insulator; etching the silicon underlying the insulator; further etching the insulator; and depositing one of a metal film and a film of low work function material on the substrate and the plurality of features.

In another non-limiting embodiment, a method of fabricating a vacuum electronics device includes: providing a silicon wafer; depositing a dielectric layer on the silicon wafer; depositing a layer of conductive material on the dielectric layer; patterning with photoresist a plurality of features including at least one focus grid and at least one acceleration grid; etching to the dielectric layer the conductive material overlying the dielectric layer; etching the dielectric layer; etching the silicon underlying the dielectric layer; and further etching the dielectric layer.

The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the text (e.g., claims and/or detailed description) and/or drawings of the present disclosure.

BRIEF DESCRIPTION OF THE FIGURES

Illustrative embodiments are illustrated in referenced figures of the drawings. It is intended that the embodiments and figures disclosed herein are to be considered illustrative rather than restrictive.

FIG. 6 is a plot of electron trajectories generated by computer simulation of the vacuum electronic devices of FIGS. 2-5.

FIGS. 7A-7H are cross-sectional views in partial schematic form of steps of an illustrative process of fabricating a vacuum electronic device.

DETAILED DESCRIPTION

Figure 1:
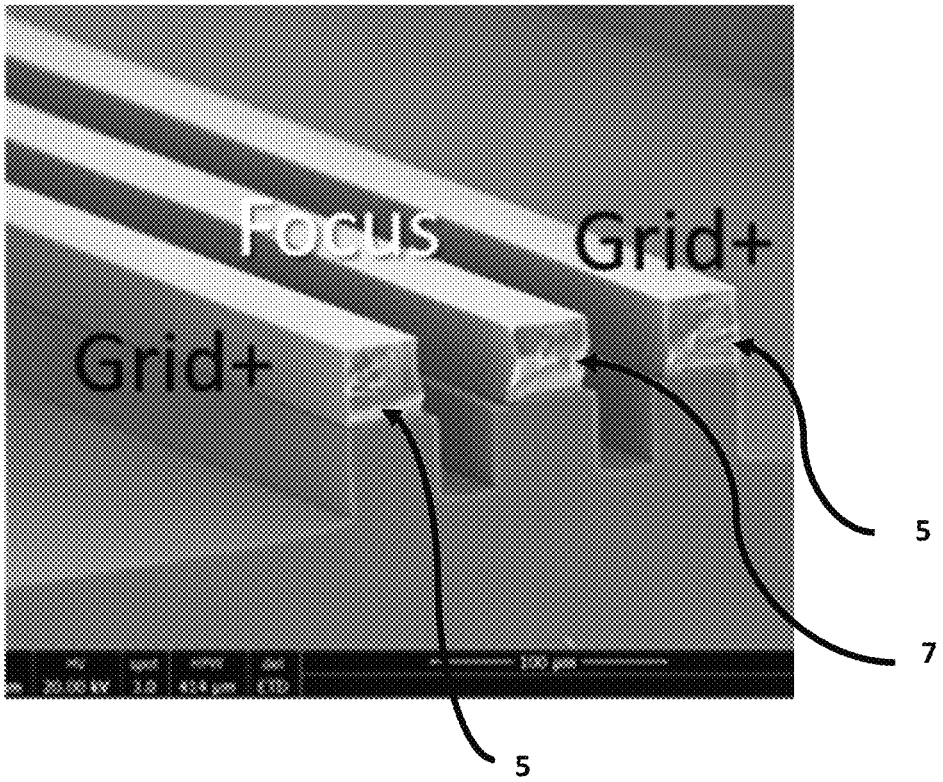
FIG. 1 is a scanning electron microscope image of an illustrative grid structure.

In the following detailed description, reference is made to the accompanying drawings, which form a part hereof. In the drawings, the use of the same symbols in different drawings typically indicates similar or identical items unless context dictates otherwise. The illustrative embodiments described in the detailed description, drawings, and claims are not meant to be limiting. Other embodiments may be utilized, and other changes may be made, without departing from the spirit or scope of the subject matter presented here.

Given by way of non-limiting overview, illustrative embodiments disclose vacuum electronic devices and methods for fabricating vacuum electronic components that include at least one electrostatic grid, which, at some distance from the surface of a cathode and at some negative applied bias, creates an electric field profile near the cathode surface which can help contribute to reducing electron space charge. In various embodiments and referring to FIG. 1, a grid set includes two grid electrodes that are positively biased acceleration grid lines 5 which accelerate electrons from the cathode (and thus mitigate space charge) and a third grid electrode that is a negatively biased focus grid line 7 that is located between and in close physical proximity to the acceleration grid lines 5. The focus grid 7 provides electrostatic shielding of the acceleration grid(s) 5 to minimize absorption of electrons by the acceleration grid(s) 5. In some embodiments, electron emission from the cathode surface can be localized via the resulting electric potential profile near the cathode surface. To that end, various embodiments disclosed herein can help reduce electron space charge, and/or electrostatically localize electron emission from a cathode surface, and/or focus electron emission from a cathode surface via one or more focus grids that are not in physical contact with the cathode.

To avoid significant power losses, in various disclosed embodiments the electron absorption cross-section of the acceleration grid 5 is decreased and the electron absorption cross-section of the anode is increased. This approach allows a large portion of the electrons emitted from the cathode to make it across the gap to the anode. As will be discussed below, this approach seeks to optimize the electron optics of the system—that is, by tailoring the geometry and voltages of the focus grid 7, acceleration grid(s) 5, and supporting structures—to sculpt the potential profile such that electrons are both accelerated away from the cathode by the positively-biased acceleration grid 5 and steered around the acceleration grid by the negatively-biased focus grid 7. It will be appreciated that use of such a periodic configurations of acceleration grid(s) 5 and focus grid(s) 7 can help contribute to reducing energy losses to the acceleration grid 5 while helping to contribute to enhancing anode current via space charge reduction.

As mentioned above, in some embodiments the geometry and voltages may result in localized emission from the cathode surface and in some other embodiments the geometry and voltages may not result in localized emission from the cathode surface. However, in all disclosed embodiments electron space charge is reduced—regardless of whether or not emission from the cathode surface is localized. These embodiments can help reduce cathode complexity because the cathode does not have grids attached directly to its surface. Because alignment between the focus grid 7 and the acceleration grid 5 is only on the anode side, various embodiments can help reduce chances for misalignment between the emitting area of the cathode and the accelerating region of the anode. When used in a thermionic generator, a reduction in misalignment can help prevent thermionic electrons being emitted in closer proximity to the acceleration grid 5, thereby helping to reduce degradations in device efficiency.

In some embodiments several acceleration grid(s) 5 and/or several focus grid(s) 7 may be incorporated into one or more periods of the overall structure. These acceleration grid(s) 5 and focus grid(s) 7 may be arranged in various geometries suited to sculpt electric potential profiles which mitigate space charge while reducing electron absorption by the acceleration grid(s) 5. The acceleration grid(s) 5 and focus grid(s) 7 may be arranged vertically, horizontally, or in any three-dimensional configuration with respect to one another. Voltages applied to the acceleration grid(s) 5 and focus grid(s) 7 may be static or time-varying, positive or negative.

Still by way of non-limiting overview and referring additionally to FIGS. 2-5, illustrative embodiments of vacuum electronic devices 100 (FIG. 2), 200 (FIG. 3), 300 (FIG. 4) and 400 (FIG. 5) include a cathode 1 and an anode 3. At least one focus grid 7 is disposed between the cathode 1 and the anode 3, and the at least one focus grid 7 is physically disconnected from the cathode 1. The at least one acceleration grid 5 is disposed between the cathode 1 and the anode 3, and the at least one acceleration grid 5 is further disposed adjacent the at least one focus grid 7. The at least one acceleration grid 5 is physically disconnected from the cathode 1.

Figure 2:
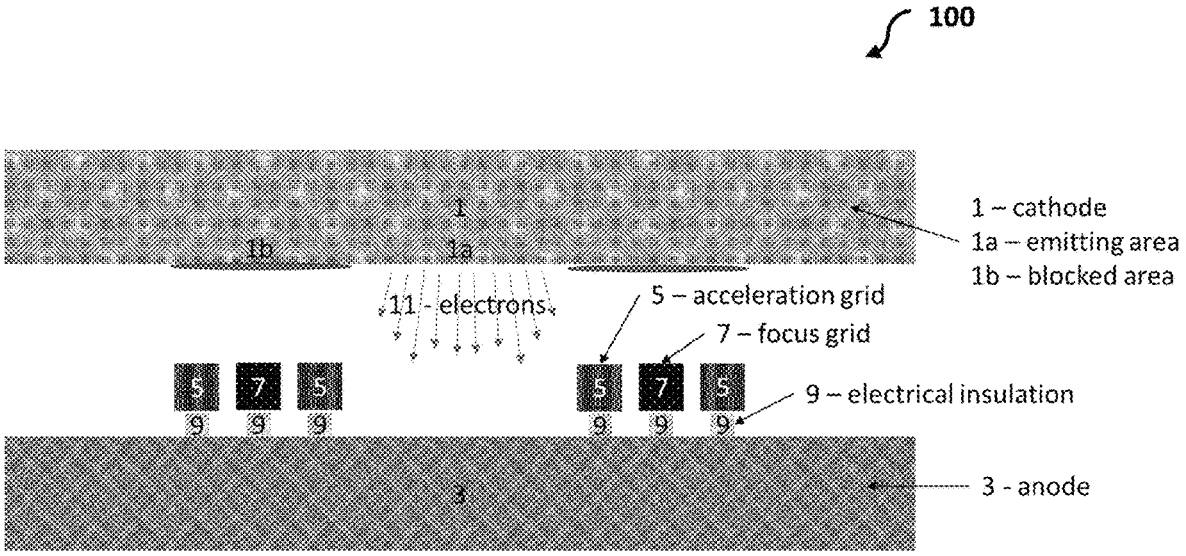
FIG. 2 is a cross-sectional view in partial schematic form of an illustrative vacuum electronic device.
Figure 3:
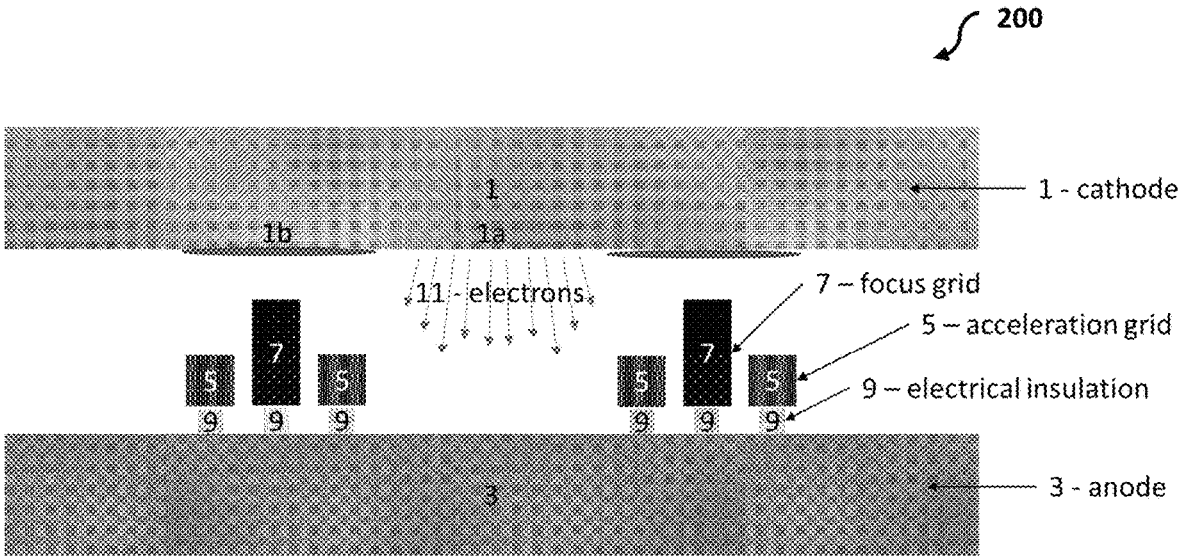
FIG. 3 is a cross-sectional view in partial schematic form of another illustrative vacuum electronic device.
Figure 4:
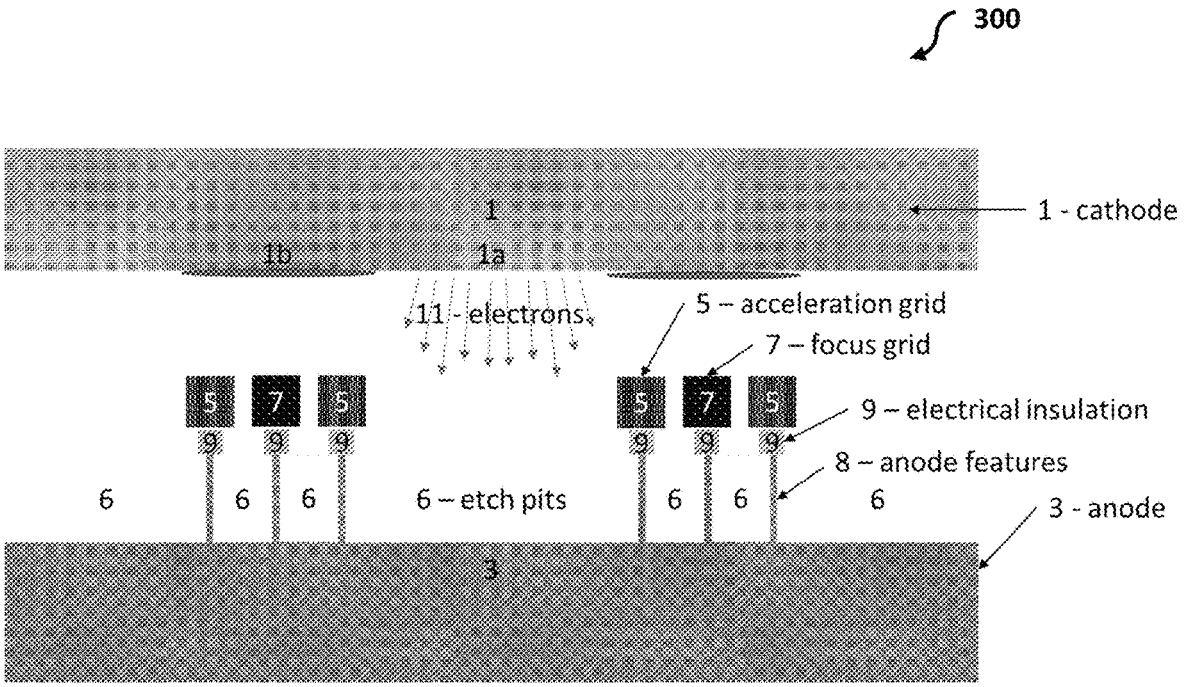
FIG. 4 is a cross-sectional view in partial schematic form of another illustrative vacuum electronic device.
Figure 5:
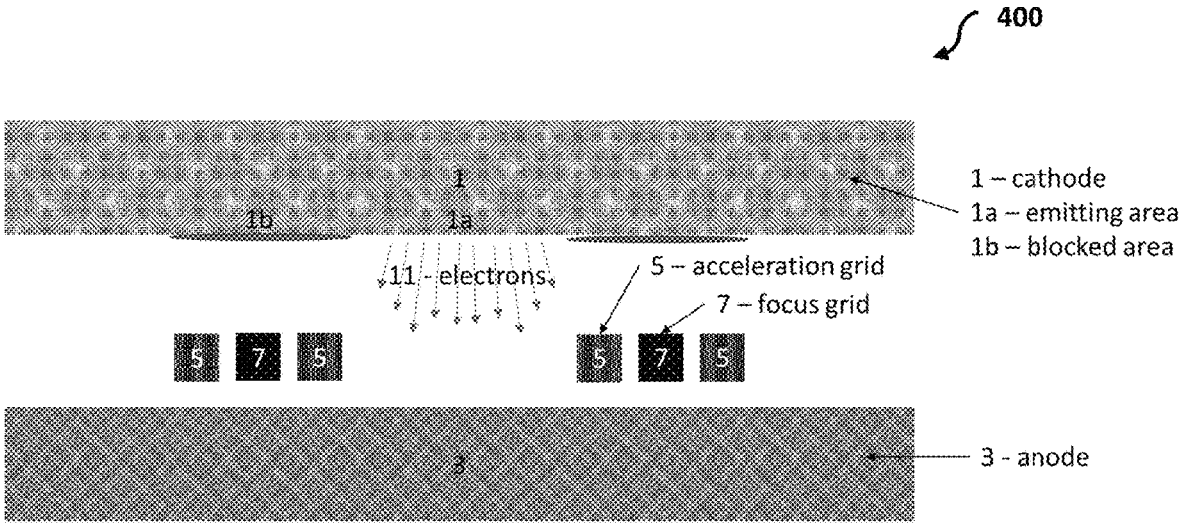
FIG. 5 is a cross-sectional view in partial schematic form of another illustrative vacuum electronic device.

Still by way of overview and as shown in FIGS. 2-5, it will be appreciated that in various embodiments the at least one acceleration grid 5 and the at least one focus grid 7 are physically disconnected from the cathode 1. In some of these embodiments and as shown in FIGS. 2-4, while the at least one acceleration grid 5 and the at least one focus grid 7 are physically disconnected from the cathode 1, the at least one focus grid 7 and the at least one acceleration grid 5 may be physically connected to the anode 3. However, in some other embodiments and as shown in FIG. 5, the at least one acceleration grid 5 and the at least one focus grid 7 are physically disconnected not just from the cathode 1 but are also physically disconnected from the anode 3.

Regardless of whether the at least one acceleration grid 5 and the at least one focus grid 7 are physically disconnected from only the cathode 1 (as shown in FIGS. 2-4) or the at least one acceleration grid 5 and the at least one focus grid 7 are physically disconnected from both the cathode 1 and the anode 3 (as shown in FIG. 5), the various embodiments disclosed herein can help contribute to: reducing complexity of the cathode 1 because the cathode 1 does not have grids 5 and 7 attached directly to its surface; and/or reducing chances for misalignment between the emitting area of the cathode 1 and the accelerating region of the anode 3; and/or preventing thermionic electrons being emitted in closer proximity to the acceleration grid 5, thereby helping to reduce degradations in device efficiency.

Also regardless of whether the at least one acceleration grid 5 and the at least one focus grid 7 are physically disconnected from only the cathode 1 (as shown in FIGS. 2-4) or the at least one acceleration grid 5 and the at least one focus grid 7 are physically disconnected from both the cathode 1 and the anode 3 (as shown in FIG. 5), some of the embodiments disclosed herein can help contribute to establishing localized emission of electrons—that is, one or more electrostatically blocked areas 1*b* of the cathode 1 and one or more localized emitting areas 1*a* of the cathode 1 due to the presence of electric fields that are created by biases applied the one or more focus grid(s) 7 and the one or more acceleration grid(s) 5.

However, it is emphasized and it will be appreciated that localizing emission from the cathode 1 is not necessary and/or essential to the ability of some disclosed embodiments to reduce and/or mitigate space charge while avoiding significant absorption of electrons by the acceleration grid(s) 5. In some regimes of operation of devices of some embodiments, the focus grid(s) 7 may not be sufficiently negatively biased and/or may not be disposed in close enough proximity to the surface of the cathode 1 to localize emission from the cathode 1—but may still provide sufficient deflection of electrons around the acceleration grid(s) 5 to avoid significant absorption of electrons by the acceleration grid(s) 5.

Now that a non-limiting overview has been provided, illustrative details regarding illustrative embodiments of vacuum electronic devices, methods of operating a vacuum electronic device, and methods of fabricating a vacuum electronic device will be set forth below by way of non-limiting examples and not of limitation.

Referring to FIGS. 2-5, in various embodiments the vacuum electronic devices 100 (FIG. 2), 200 (FIG. 3), 300 (FIG. 4) and 400 (FIG. 5) may be any vacuum electronic device as desired. By way of non-limiting example, in some illustrative embodiments the vacuum electronic devices 100 (FIG. 2), 200 (FIG. 3), 300 (FIG. 4) and 400 (FIG. 5) may include a thermionic converter. However, in other illustrative embodiments, the vacuum electronic devices 100 (FIG.

2), 200 (FIG. 3), 300 (FIG. 4) and 400 (FIG. 5) may include without limitation inductive output tubes, ion thrusters, accelerators including on-chip particle accelerators, gridded tubes, amplifiers, and/or electron guns.

In some embodiments the cathode 1 may be a solid electrode made from a metal or a compound such as tungsten, rhenium, molybdenum, lanthanum hexaboride, or the like. In some other embodiments the cathode 1 may be an oxide-coated metal electrode. In such embodiments, the cathode 1 may be coated with an oxide such as a barium oxide, strontium oxide, calcium oxide, or the like, or any mixture thereof. In some other embodiments, the cathode 1 may be a metal matrix cathode impregnated with a low-work function material, such as barium oxide, strontium oxide, calcium oxide, or the like, or any mixture thereof. In various embodiments the cathode 1 is heated to temperatures of at least several hundred degrees Celsius to induce thermionic or Schottky emission of electrons 11.

In various embodiments the cathode 1 is disposed in close proximity to the anode 3. In various embodiments, the cathode 1 may be disposed within a range of single microns to millimeters (that is, 10^-6 to 10^-3 m) to the anode 3. In various embodiments the anode 3 may be metallic, semiconducting, or a low-work-function material, or may include an insulating substrate with a metallic, semiconducting, or low-work-function film or coating. Metallic materials may include, without limitation: refractory metals such as (but not limited to) tungsten, molybdenum, niobium, or tantalum; other transition metals such as (but not limited to) silver, platinum, osmium, iridium, ruthenium, rhodium, gold, nickel, copper, titanium, or chromium; and various compounds and alloys thereof. Semiconducting materials may include, without limitation: group IV semiconductors such as silicon, germanium, carbon, or any alloy thereof; III-V compound semiconductors such as GaAs, GaN, InP, BN, or any combination or alloy thereof; and II-VI semiconductors such as ZnO, ZnS, ZnSe, CdTe, or any combination or alloy thereof. Low-WF materials may include, without limitation: alkali metals such as (but not limited to) Cs, Ba, Mg, and oxides, compounds, and alloys thereof; LaB6; and thoriated tungsten.

In various embodiments the at least one acceleration grid 5 may be metallic, semiconducting, or a low-work-function material, or may include an insulating material with a metallic, semiconducting, or low-work-function film or coating. Metallic materials may include, without limitation: refractory metals such as (but not limited to) tungsten, molybdenum, niobium, or tantalum; other transition metals such as (but not limited to) silver, platinum, osmium, iridium, ruthenium, rhodium, gold, nickel, copper, titanium, or chromium; and various compounds and alloys thereof. Semiconducting materials may include, without limitation: group IV semiconductors such as silicon, germanium, carbon, or any alloy thereof; III-V compound semiconductors such as GaAs, GaN, InP, BN, or any combination or alloy thereof; and II-VI semiconductors such as ZnO, ZnS, ZnSe, CdTe, or any combination or alloy thereof. Low-WF materials may include, without limitation: alkali metals such as (but not limited to) Cs, Ba, Mg, and oxides, compounds, and alloys thereof; LaB6; and thoriated tungsten.

In various embodiments, the at least one focus grid 7 may be metallic, semiconducting, or a low-work-function material, or may include an insulating material with a metallic, semiconducting, or low-work-function film or coating. Metallic materials may include, without limitation: refractory metals such as (but not limited to) tungsten, molybdenum, niobium, or tantalum; other transition metals such as (but not limited to) silver, platinum, osmium, iridium, ruthenium, rhodium, gold, nickel, copper, titanium, or chromium; and various compounds and alloys thereof. Semiconducting materials may include, without limitation: group IV semiconductors such as silicon, germanium, carbon, or any alloy thereof; III-V compound semiconductors such as GaAs, GaN, InP, BN, or any combination or alloy thereof; and II-VI semiconductors such as ZnO, ZnS, ZnSe, CdTe, or any combination or alloy thereof. Low-WF materials may include, without limitation: alkali metals such as (but not limited to) Cs, Ba, Mg, and oxides, compounds, and alloys thereof; LaB6; and thoriated tungsten.

It will be appreciated that in various embodiments the at least one focus grid 7 may help contribute to reducing space charge and in some embodiments the at least one focus grid 7 may help contribute to electrostatically localizing electron emission from the cathode 1. Regardless of whether or not the emitting area may be sufficiently localized by the at least one focus grid 7, in various disclosed embodiments the electrons 11 emitted from the cathode 1 may be accelerated by the at least one acceleration grid 5 without unduly impacting the electrons 11 and without helping contribute to grid loss.

As shown in FIGS. 2-4, the at least one acceleration grid 5 and the at least one focus grid 7 may be provided as features patterned on the anode 3. As such, in such embodiments the at least one acceleration grid 5 and the at least one focus grid 7 are, at least indirectly, physically connected to the anode 3. For example, in some such embodiments the at least one acceleration grid 5 and the at least one focus grid 7 may be physically disposed directly on at least one electrically insulating support 9 which is, in turn, physically disposed directly on the anode 3. In such embodiments, the at least one electrically insulating support 9 may help electrically isolate the at least one acceleration grid(s) 5 and/or the at least one focus grid 7 from the anode 3 and/or other acceleration grid(s) 5 and/or other focus grid(s) 7, may help provide mechanical stability, may help provide thermal insulation, and may help contribute to compatibility with micro- or nanofabrication techniques. In such embodiments, the electrically insulating supports 9 may include electrically insulating materials such as but not limited to: metal oxides such as silicon oxide, aluminum oxide, scandium oxide, zirconium oxide, hafnium oxide, and the like; metal nitrides such as silicon nitride, aluminum nitride, zirconium nitride, and the like; and insulating ceramics, plastics, and polymers such as PTFE, PET, and the like.

As shown in FIG. 3, in some embodiments the at least one focus grid 5 may be different from the at least one acceleration grid 7 in ways including, but not limited to, size, shape, distance from the anode 3, distance from the cathode 1, and material composition.

As shown in FIG. 4, in some embodiments the anode 3 may define features 8 which include electrically insulating supports 6 for the at least one acceleration grid 5 and/or the at least one focus grid 7. In some such embodiments voids 6 may be defined between the anode features 8. The voids 6 are referred to herein as etch pits 6 due to chemical etching as one possible way of forming the voids 6. The etch pits 6 may be provided for reasons including, but not limited to, enhanced absorption of electrons 11 by the anode 3. It will be appreciated that the etch pits 6 may vary in size, shape, depth, and the features 8 may have different materials or coatings as desired for a particular application. The features 8 may include materials and coatings that may include electrically insulating materials such as but not limited to: metal oxides such as silicon oxide, aluminum oxide, scandium oxide, zirconium oxide, hafnium oxide, and the like; metal nitrides such as silicon nitride, aluminum nitride, zirconium nitride, and the like; and insulating ceramics, plastics, and polymers such as PTFE, PET, and the like. In addition, the features 8 may include, without limitation: tungsten, molybdenum, niobium, and tantalum; other transition metals such as (but not limited to) silver, platinum, nickel, osmium, iridium, ruthenium, rhodium, copper, titanium, chromium, and gold; compounds and alloys thereof; low-work-function materials such as (but not limited to) Cs, Ba, Mg, and oxides, compounds, and alloys thereof; LaB6; and thoriated tungsten.

However, as shown in FIG. 5, in some embodiments the at least one acceleration grid 5 and the at least one focus grid 7 may be at least partially physically disconnected from both the cathode 1 and the anode 3. That is, in such embodiments the at least one acceleration grid 5 and the at least one focus grid 7 are suspended between the cathode 1 and the anode 3. For example, in such embodiments the at least one acceleration grid 5 and the at least one focus grid 7 are physically disconnected from both the cathode 1 and the anode 3—but may be physically connected to a ring or the like about the periphery of a wafer (such as a silicon wafer or the like) on which the vacuum electronic device 400 is fabricated.

Such embodiments provide a vacuum gap between the anode 3 and the at least one acceleration grid 5 and/or the at least one focus grid 7. This vacuum gap is desirable because it avoids use of dielectric supports for the grids. As will be appreciated, it is preferable to electrically isolate the grids 5 and 7 from the anode 3 using vacuum rather than dielectric (that is, as much as may be physically possible) due to a tendency of dielectrics to tend to leak, break down, and/or charge up (especially when under impingement from electrons from the cathode 1).

In various embodiments and referring to FIGS. 2-5, the at least one acceleration grid 5 is held at a positive voltage bias relative to the cathode 1 to accelerate the emitted electrons 11 from the surface of the cathode 1. Conversely, the at least one focus grid 7 is held at a negative voltage bias relative to the cathode 1 to deflect electrons away from the at least one acceleration grid 5, thereby helping to reduce absorption of the emitted electrons 11 by the acceleration grid 5.

It will be appreciated that in some embodiments the at least one focus grid 7 is held at a sufficient negative voltage bias and is within a sufficiently small distance from the surface of the cathode 1 such that, in the vicinity of the blocked area 1*b* of the cathode 1 that is in closest proximity to the at least one focus grid 7, the resulting electric potential in the vacuum just outside of the surface of the cathode is negative with respect to the electric potential at the surface of the cathode. It will be appreciated that distance from the surface of the cathode 1 may depend, at least in part, on voltage at the focus grid 7, distance from the focus grid 7 to the cathode 1, voltage at the acceleration grid 5, and/or distance from the acceleration grid 5 to the cathode 1. Typical distance ranges may range from single microns to millimeters (that is, 10^-6 to 10^-3 m). Typical voltage ranges may be on the order of single volts to thousands of volts. For example and by way of non-limiting example, a focusing grid voltage of −50 V, with an accelerating grid voltage of 20 V, grid width of 2 microns, grid depth of 10 microns, etch pit depth of 15 microns, at a grid cathode spacing of 15 microns is sufficient to induce localized electron emission suppression directly above the focusing grid and extending out above the acceleration grids. While a lower focusing grid bias could still locally suppress emission to a lesser extent, the electron optics are unfavorable and leads to electrons striking the acceleration grids. Reducing the focus grid voltage to 0 V will effectively remove the local suppression of electronic emission. Moving the grids sufficiently far away from the cathode (e.g. $D_{CG}$>100 micron) will also be in a regime where localized electronic emission is not suppressed.

It will be noted that the electric potential at the surface of the cathode 1 is, by definition, uniform with respect to position on the surface of the cathode 1. This uniformity is because the cathode 1 is made of an electrically conductive material. In this at least one blocked area 1*b* of the surface of the cathode 1 the resulting electric field produces an electric force F (vector) which repels the electrons 11 back to the cathode 1 and which is given according to equation 1:

$$F=qE \tag{1}$$

where q=charge (scalar); and

E=electric field (vector).

Thus, relatively few electrons 11 are emitted in the at least one blocked area 1*b* of the surface of the cathode 1. On the other hand, the at least one localized emitting area 1*a* outside of the at least one blocked area 1*b* can emit a much greater number of electrons 11 with respect to the at least one blocked area 1*b*. This increased emission is due to the resulting electric potential in the vacuum just outside of the at least one localized emitting area 1*a* being positive with respect to the electric potential at the surface of the cathode 1. This positive electric potential results in an electric field E that produces an electric force F which accelerates electrons 11 away from the cathode 1.

As a result, the at least one localized emitting area 1*a* of the surface of the cathode 1 emits a much greater number of electrons 11 than the at least one blocked area 1*b* of the surface of the cathode 1. Thus, it will be appreciated that the presence of the at least one blocked area 1*b* of the cathode 1 and the at least one localized emitting area 1*a* of the cathode 1 result from the presence of electric fields that are created by biases applied to the at least one focus grid 7 and the at least one acceleration grid 5, thereby creating localized emission of the electrons 11.

It will be appreciated that power output and loss may be dependent on voltages applied to the at least one acceleration grid 5 and the at least one focus grid 7, so voltages can be applied to maximize either current or efficiency. Additionally, it would be possible to apply specific voltages to specific periods of acceleration grid(s) 5 and focus grid(s) 7 in a larger device to maximize performance, either in terms of efficiency or current. It will also be appreciated that, in some embodiments, the voltage biases applied to the at least one acceleration grid 5 and/or the at least one focus grid 7 may be time-varying, for reasons including, but not limited to, controlling and/or suppressing emission of the electrons 11 from the cathode 1.

It will also be appreciated that spacing between specific periods of acceleration grid(s) 5 and focus grid(s) 7 may be selected as desired for a particular application. Given by way of illustration only and not of limitation, in various embodiments spacing between specific periods of acceleration grid(s) 5 and focus grid(s) 7 may range from single microns to many hundreds of microns or, in some cases, to millimeters.

Referring additionally to FIG. 6, electron trajectories are shown in a simulation plot 500. The simulation plot 500 has been generated by computer simulation of the vacuum electronic devices 100 (FIG. 2), 200 (FIG. 3), 300 (FIG. 4)

and 400 (FIG. 5). In the simulation plot 500, the cathode 1 (FIGS. 2-5) is to the left, the anode 3 (FIGS. 2-5) is to the right, and lines 13 represent electron trajectories. For the reasons discussed above, emission of electrons 11 is substantially limited to areas between the acceleration grid(s) 5. As also discussed above, the emitted electrons 11 are collimated and focused through the acceleration grid(s) 5 and are collected by the anode 3.

It will also be appreciated that in some other embodiments localizing emission from the cathode 1 is not necessary and/or essential to the ability of such embodiments to reduce and/or mitigate space charge while avoiding significant absorption of electrons by the acceleration grid(s) 5. As mentioned above, in some regimes of operation of devices of such embodiments, the focus grid(s) 7 may not be sufficiently negatively biased and/or may not be disposed in close enough proximity to the surface of the cathode 1 to localize emission from the cathode 1—but may still provide sufficient deflection of electrons around the acceleration grid(s) 5 to avoid significant absorption of electrons by the acceleration grid(s) 5. For example and by way of non-limiting example, a focus grid voltage of −50 V, and acceleration grid voltage of 20 V with a cathode grid spacing of 200 microns, grid widths of 40 microns, and an etch pit depth of 60 microns gives a geometry where space charge is somewhat mitigated, however the cathode is not electrostatically limited.

Referring additionally to FIGS. 7A-7H, illustrative methods of fabricating the devices of FIGS. 2-4 will be set forth by way of illustrative examples. It will be appreciated that, by way of illustration only and not of limitation, FIGS. 7A-7H illustrate a fabrication process that shows a single set of grids in which the focus grid is in the center and is surrounded by two acceleration grids.

Referring to FIG. 7A, an illustrative method uses a silicon-on-insulator substrate. The device layer (upper silicon) will become the focus grid 7 and the acceleration grid(s) 5. The handle layer (lower silicon) will create the anode 3. Buried oxide creates electrical insulation (that is, the electrically insulating supports 9) between the anode 3 and the grids (that is, the focus grid 7 and the acceleration grid(s) 5).

Referring to FIG. 7B, photoresist can be used to pattern features on the surface to pattern the focus grid 7 and/or the acceleration grid(s) 5. Given by way of non-limiting example, these grids can range from tens of nanometers to tens of micrometers in widths, with lengths dependent on the size of the cathode.

Referring to FIG. 7C, the device layer can be etched down to the buried oxide layer using any number of appropriate silicon etches (such as deep silicon etching using switched $SF_6/C_4F_8$ processing, or a $SF_6/O_2$ mixed process at cryogenic temperatures, or any number of other silicon etches).

Referring to FIG. 7D, the oxide can be etched again using dry plasma etching with, for example, $CHF_3/O_2$ or $CF_4/O_2$ gases in a reactive ion etcher or an inductively coupled reactive ion etcher. Alternatively, a wet etch could be used to similar effect.

Referring to FIG. 7E, the handle layer can be etched further, thereby creating recesses in the anode 3. The recesses can help with electron absorption, because most of the negative field from the anode 3 is kept further from the acceleration grids.

Referring to FIG. 7F, after appropriate cleaning the oxide layer can be isotropically etched so that there is no electrical insulator 9 exposed to evaporation from the cathode (not shown). Otherwise, cathode evaporation could electrically short the grids 5 and 7 to the anode 3, thereby shortening the lifetime of the device.

Referring to FIG. 7G, optionally and if desired an electrically conductive coating may be deposited over the acceleration grids, focus grids, and anode to enhance electrical conductivity and/or help provide protection of the substrate material against corrosive materials, such as cesium or barium, that may be used to lower the work function of the anode surface. In various embodiments the electrically conductive coating may include, without limitation: metals such as (but not limited to) tungsten, molybdenum, niobium, tantalum; other transition metals such as (but not limited to) silver, platinum, gold, nickel, copper, titanium, chromium, osmium, iridium, ruthenium, rhodium; and alloys and compounds thereof. This deposition could be accomplished using atomic layer deposition or other appropriate deposition techniques, such as without limitation certain forms of evaporation, sputtering, and/or chemical vapor deposition, to get a conformal coating over the acceleration grids, focus grids, and anode.

Referring to FIG. 7H, a suitable method can be used to deposit metal or other low work function material on the anode 3 or the grids (that is, the focus grid 7 and the acceleration grid(s) 5) without shorting the grids 5 and 7 to the anode 3. Given by way of illustration and not of limitation, suitable deposition methods include without limitation: certain forms of evaporation, sputtering, chemical vapor deposition, and/or atomic layer deposition.

A similar fabrication process may be performed using different starting materials (that is, materials other than a silicon-on-insulator wafer). For example, a thermal oxide or other dielectric (such as silicon nitride) may be deposited on a silicon wafer, and then highly-doped polysilicon or other conductive material (such as tungsten or nickel) may be deposited on the dielectric. Similarly, metal, then dielectric, then metal may be deposited for use as an initial substrate for patterning. Then, the films may be etched back and processed in the method described above. It will be appreciated that in such embodiments a step of depositing one of a metal film and/or a film of low work function material on the silicon wafer and the plurality of features is not necessary per se. The metal film may not be necessary if the substrate is conductive. The low work function material may not be necessary if, for example, Cs vapor is used to achieve a low work function surface. That is, a film of low work function material is not necessary to have a low work function surface. Instead and given by way of non-limiting example, low work function vapor atoms may be deposited on a metal surface.

Another illustrative method creates structures by building the structures from the bottom up. For example, a metal substrate may be used as a base to electroplate a pillar thereon and that may then be coated with dielectric. A second pillar may then be aligned to and electroplated on top of the first pillar. Lastly, the dielectric may be etched in a similar manner to that shown in FIG. 7F to create desired undercut structures.

It will be appreciated that the vacuum electronics device 400 (FIG. 5) may be fabricated in a similar manner as described above with the following modifications. The supporting dielectric layer is etched away using any acceptable etching process, such as a wet etching process or a dry etching process. It will be appreciated that this etching step leaves only supporting structures on the periphery or periodically-spaced supporting structures that have relatively large pitch.

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While a number of illustrative embodiments and aspects have been illustrated and discussed above, those of skill in the art will recognize certain modifications, permutations, additions, and sub-combinations thereof. It is therefore intended that the following appended claims and claims hereafter introduced are interpreted to include all such modifications, permutations, additions, and sub-combinations as are within their true spirit and scope.

What is claimed is:

1. A vacuum electronic device comprising:

a cathode comprising at least one electron-emitting region;

an anode;

at least one focus grid disposed between the cathode and the anode and laterally spaced apart from the at least one electron-emitting region of the cathode by a first distance, the at least one focus grid configured to be negatively biased; and at least one acceleration grid disposed entirely between the cathode and the anode and laterally spaced apart from the at least one electron-emitting region of the cathode by a second distance less than the first distance, the at least one acceleration grid being disposed adjacent the at least one focus grid, the at least one acceleration grid configured to be positively biased.

2. The device of claim 1, wherein the at least one focus grid and the at least one acceleration grid are physically connected to the anode.

3. The device of claim 2, wherein each of the at least one focus grid and the at least one acceleration grid are physically connected to the anode via an associated one of a plurality of electrically insulating supports that is physically connected to the anode.

4. The device of claim 3, wherein the plurality of electrically insulating supports are made from an electrically insulating material chosen from metal oxides, silicon oxide, aluminum oxide, scandium oxide, zirconium oxide, hafnium oxide, metal nitrides, silicon nitride, aluminum nitride, zirconium nitride, insulating ceramics, plastics, polymers, PTFE, and PET.

5. The device of claim 3, wherein:

the anode defines a plurality a features separated by voids defined therebetween; and each of the plurality of electrically insulating supports is physically connected to an associated one of the plurality of anode features.

6. The device of claim 1, wherein the at least one focus grid and the at least one acceleration grid are physically disconnected from the anode.

7. The device of claim 1, wherein at least one attribute chosen from size, shape, distance from the anode, distance from the cathode, and material composition is different between the at least one focus grid and the at least one acceleration grid.

8. The device of claim 1, wherein the cathode includes at least one of a metal, tungsten, rhenium, molybdenum, lanthanum hexaboride, barium oxide, strontium oxide, calcium oxide, and a metal matrix impregnated with a low-work function material including at least one of barium oxide, strontium oxide, and calcium oxide.

9. The device of claim 1, wherein the anode includes one of a metallic substrate, a semiconducting substrate, and an insulating substrate with one of a metallic coating and a semiconducting coating.

10. The device of claim 1, wherein the at least one acceleration grid includes one of a metal, a semiconductor, and an insulating material including one of a metallic coating and a semiconducting coating.

11. The device of claim 1, wherein the at least one focus grid includes one of a metal, a semiconductor, and an insulating material including one of a metallic coating and a semiconducting coating.

12. The device of claim 1, wherein the anode faces the cathode and includes an exposed anode surface positioned to directly receive electrons emitted directly from the cathode-emitting region.

13. The device of claim 1, wherein the cathode further comprises an electron-blocking region adjacent the at least one electron-emitting region and configured to inhibit electrons from being emitted from the cathode toward the anode.

14. The device of claim 1, wherein the at least one focus grid is a first focus grid on a first side of the electron-emitting region and the at least one acceleration grid is a first acceleration grid on the first side of the electron-emitting region, the device further comprising:

a second acceleration grid on a second side of the electron-emitting region, the second acceleration grid configured to be positively biased; and a second focus grid on the second side of the electron-emitting region and outward from both the second acceleration grid and the electron-emitting region, wherein the first focus grid, second focus grid, first acceleration grid, and second acceleration grid are disposed over and coupled to the anode.

15. A vacuum electronics device comprising:

a cathode comprising an electron-emitting region;

an anode;

at least one focus grid disposed entirely between the cathode and the anode, the at least one focus grid being laterally spaced apart from the electron-emitting region; and at least one acceleration grid disposed entirely between the cathode and the anode, the at least one acceleration grid being laterally spaced apart from the electron-emitting region and laterally between the electron-emitting region and the at least one focus grid, wherein the at least one focus grid is configured to be negatively biased relative to the acceleration grid, and wherein the acceleration grid is configured to be positively biased relative to the focus grid.

16. The device of claim 15, wherein the at least one focus grid and the at least one acceleration grid are physically connected to the anode.

17. The device of claim 16, wherein each of the at least one focus grid and the at least one acceleration grid are physically connected to the anode via an associated one of a plurality of electrically insulating supports that is physically connected to the anode.

18. The device of claim 17, wherein the plurality of electrically insulating supports are made from an electrically insulating material chosen from metal oxides, silicon oxide, aluminum oxide, scandium oxide, zirconium oxide, hafnium oxide, metal nitrides, silicon nitride, aluminum nitride, zirconium nitride, insulating ceramics, plastics, polymers, PTFE, and PET.

19. The device of claim 17, wherein:

the anode defines a plurality a features separated by voids defined therebetween; and each of the plurality of electrically insulating supports is physically connected to an associated one of the plurality of anode features.

20. The device of claim 15, wherein the at least one focus grid and the at least one acceleration grid are physically disconnected from the anode.

21. The device of claim 15, wherein at least one attribute chosen from size, shape, distance from the anode, distance from the cathode, and material composition is different between the at least one focus grid and the at least one acceleration grid.

22. The device of claim 15, wherein the anode includes one of a metallic substrate, a semiconducting substrate, and an insulating substrate with one of a metallic coating and a semiconducting coating.

23. The device of claim 15, wherein the at least one acceleration grid includes one of a metal, a semiconductor, and an insulating material including one of a metallic coating and a semiconducting coating.

24. The device of claim 15, wherein the at least one focus grid includes one of a metal, a semiconductor, and an insulating material including one of a metallic coating and a semiconducting coating.

25. The device of claim 15, wherein the cathode includes at least one of a metal, tungsten, rhenium, molybdenum, lanthanum hexaboride, barium oxide, strontium oxide, calcium oxide, and a metal matrix impregnated with a low-work function material including at least one of barium oxide, strontium oxide, and calcium oxide.

26. A method of reducing electron space charge in a vacuum electronics device, the method comprising:

disposing at least one acceleration grid between an anode and a cathode facing the anode, the at least one acceleration grid being laterally outward from an electron-emitting region of the cathode;

disposing at least one focus grid between the anode and the cathode, the at least one focus grid being laterally outward from the at least one acceleration grid and the electron-emitting region;

coupling the at least one focus grid to a first power supply configured to negatively bias the at least one focus grid relative to the at least one acceleration grid; and coupling the at least one acceleration grid to a second power supply configured to positively bias the at least one acceleration grid relative to the at least one focus grid.

27. The method of claim 24, wherein coupling the at least one focus grid includes negatively biasing the at least one focus grid, causing electrons to deflect away from the at least one acceleration grid.

28. The method of claim 24, wherein coupling the at least one acceleration grid includes positively biasing the at least one acceleration grid, causing electrons emitted from the surface of the cathode to accelerate toward the anode.

29. The device of claim 26, further comprising activating at least one of the first power supply or the second power supply.

* * * * *